United States Patent [19]

Ando

[11] 4,335,065

[45] Jun. 15, 1982

[54] METHOD AND APPARATUS FOR PRODUCING MOULDINGS OF CEMENT MORTAR

[76] Inventor: Shigeo Ando, 272, Suehirocho 5 chome, Choshi-shi, Chiba 288, Japan

[21] Appl. No.: 166,919

[22] Filed: Jul. 9, 1980

[30] Foreign Application Priority Data

| | | | |
|---|---|---|---|
| Dec. 17, 1979 | [JP] | Japan | 54-162671 |
| Mar. 24, 1980 | [JP] | Japan | 55-036180 |
| Mar. 26, 1980 | [JP] | Japan | 55-037381 |
| Apr. 8, 1980 | [JP] | Japan | 55-045163 |

[51] Int. Cl.[3] ..... B28B 1/26

[52] U.S. Cl. ..... 264/87; 264/333; 425/85

[58] Field of Search ..... 264/87, 333; 425/85

[56] References Cited

U.S. PATENT DOCUMENTS

| | | | |
|---|---|---|---|
| 3,602,287 | 8/1971 | Eversdyk | 264/87 X |
| 3,697,631 | 10/1972 | Charman et al. | 264/87 X |

*Primary Examiner*—Philip Anderson

*Attorney, Agent, or Firm*—Balogh, Osann, Kramer, Dvorak, Genova & Traub

[57] ABSTRACT

A method of producing cement mortar mouldings is provided. Cement mortar material is supplied onto a lower mould. The lower mould is then brought into a vertical alignment with an upper mould. The lower and upper moulds are pressed to each other to compress the cement mortar material which is, in turn, dehydrated by suction means. While maintaining the suction, the lower mould is separated from the upper mould to leave a moulding on the upper mould. This mould is placed on a conveyor for later processing.

An apparatus for producing cement mortar mouldings is also provided. The apparatus comprises upper and lower moulds, suction means, mould actuating means, and conveyor means. The suction means is provided in association with the upper mould to assure both dehydration and holding of the molding manufactured from the compressed from the moulding material.

17 Claims, 28 Drawing Figures

METHOD AND APPARATUS FOR PRODUCING MOULDINGS OF CEMENT MORTAR

BACKGROUND OF THE INVENTION

The present invention relates to a method and apparatus for producing mouldings of cement mortar.

It is well known that tiles and like mouldings of cement mortar are produced by compressing and dehydrating a mouldable material containing a large amount of moisture and then conveying the moulded mass to a curing station. Automatic production of such mouldings involves various difficulties attributable to the fact that moulded masses do not easily separate from a mould and are very fragile.

Traditionally, use has been made of an apparatus which includes a lower mould formed with apertures for dehydration and an upper mould mounted on a high pressure piston which compresses a mouldable material on the lower mould to squeeze water out of the mouldable material. With this arrangement, however, difficulty has been experienced in automatically transferring a moulding onto a receiver plate which rests on a carriage and serves to convey a moulding to a curing station.

SUMMARY OF THE INVENTION

An object of the present invention is to provide a method and apparatus for producing cement mortar mouldings which perform all of the necessary steps automatically and at a high speed without detriment to the quality of products.

In order to achieve this object, a method and apparatus according to the present invention employs an upper mould equipped with a vacuum-operated suction device. The upper mould exerts a compressive force and a suction force simultaneously to a mouldable mass to thereby improve the forming and dehydrating efficiency. The suction force also serves to keep the moulding retained on the upper mould. When the upper mould is brought to a position where the moulding is to be transfered onto a receiver plate, the suction acting through the upper mould is stopped to allow the transfer of the moulding.

BRIEF DESCRIPTION OF THE DRAWINGS

Various features and advantages of the present invention will become apparent from the following description which is made with reference to the accompanying drawings: in which.

DETAILED DESCRIPTION OF THE PREFERRED EMBODIMENT

Figure 1:
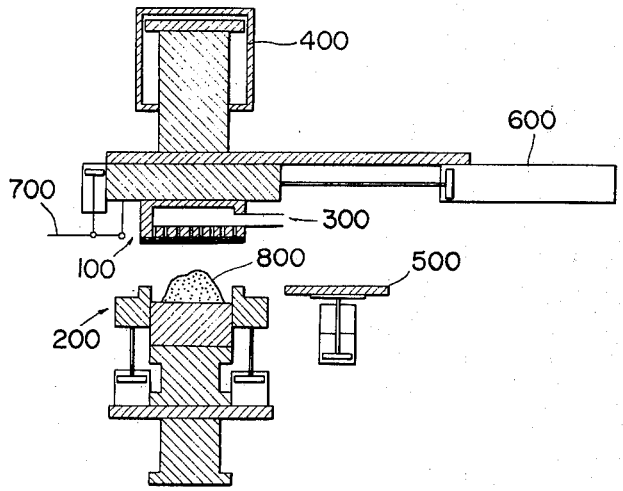
FIG. 1 is a diagrammatic front view of one typical embodiment of the present invention.
Figure 2:
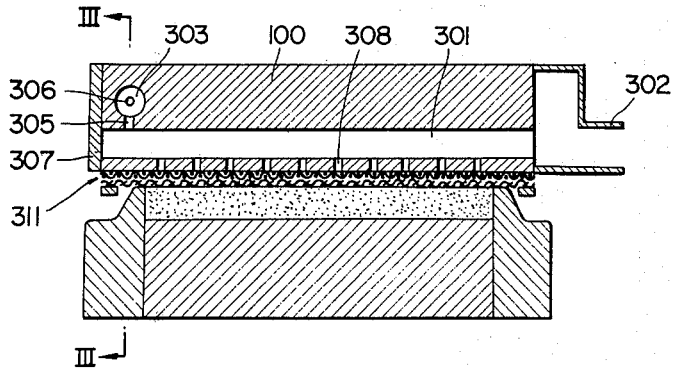
FIG. 2 is an enlarged illustration of an upper mould incorporated in the embodiment of FIG. 1.
Figure 3:
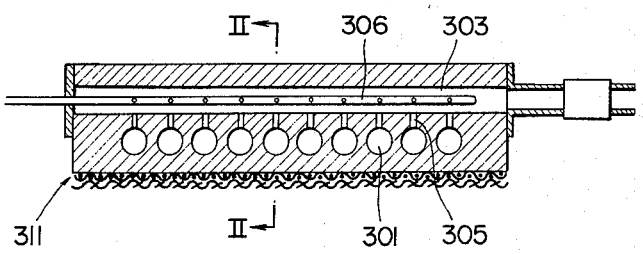
FIG. 3 is a sectional view of the upper mould taken along the line III—III of FIG. 2.

The embodiments of the present invention will be explained referring to the accompanying drawings. In FIG. 1, numeral 100 designates an upper mould whereas numeral 200 designates a lower mould. In association with said upper mould 100, vacuum-operated suction device 300 is arranged to ensure that a moulding is retained on upper mould 100 through the suction force of said device. Said upper mould 100 is actuated vertically by high pressure press piston cylinder 400 whereas lower mould 200 is maintained stationary. There is further provided carriage 500 spaced apart from said lower mould 200 by a predetermined distance. Upper mould 100 is further adapted for horizontal movement by cylinder 600 between lower mould 200 and carriage 500 for vertical alignment.

Figure 4:
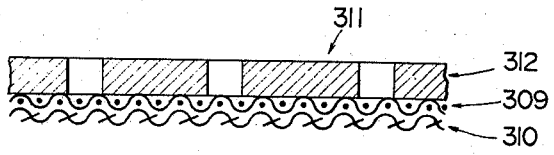
FIG. 4 is an enlarged illustration of a multi-layer filter assembly mounted on the lower end of the upper mould.

Details of the vacuum-operated suction arrangement on the upper mould 100 are illustrated in FIGS. 2 to 5. As shown, a plurality of parallel water passages or conduits 301 extend through the upper mould 100 and in common horizontal plane spaced upward from the lower end of the upper mould 100. At one side of the upper mould 100, the conduits 301 are communicated with a water collecting manifold 302 which in turn communicates to a source of vacuum supply. At the opposite side of the upper mould, the conduits 301 communicate individually with an air suction pipe 303. This pipe 303 traverses the parallel conduits 301 in a plane above the latter and communicates with them through individual bores 305. A water supply pipe 306 extends in and concentrically with the air suction pipe 303 along the axis of the pipe 303. Multiple apertures are formed through the wall of the water supply pipe 306 to provide fluid communication between the concentric interiors of the pipes 306 and 303. Those ends of the conduits 301 adjacent to the air suction pipe 303 are open to the outside while a closure plate 307 is securely mounted on that side of the upper mould where the conduits 301 are open; this structure is merely for the convenience of manufacture. A plurality of spaced channels 308 extend vertically through the upper mould to communicate the respective conduits 301 to the lower end of the upper mould. Mounted on the lower end of the upper mould is a multi-layer filter assembly 311 for squeezing water out of the mouldable material. As best shown in FIG. 4, the filter assembly 311 comprises a wire netting 309 contacting the upper mould and a piece of dehydrating cloth 310 disposed immediately below the wire netting. The filter assembly 311 may further include a drainer plate 312 made of iron and having a number of perforations in a suitable distribution. When the drainer plate 312 overlies the wire netting 309 in contact with the underside of the upper mould 100, it will not only serve the even delivery of vacuum but also further intercept various components of the mouldable material other than water.

A water-squeezing suction system associated with the arrangement discussed above is shown in FIG. 5. The suction system includes a first air-driven centrifugal separator 315 having its inlet located in an upper peripheral portion thereof and communicated with the outlet of the manifold 319 on the upper mould 100 through a flexible tube 314 such as a rubber hose. If desired, a vacuum regulator valve 316 may be disposed in the inlet of the centrifugal separator 315. A lower part of the centrifugal separator 315 is in the form of a downwardly tapered drum which connects to a drain at its lower end. A closure member or lid 317 closes the drain but is movable to open it when drainage is desired. An outlet duct is mounted on the top of the centrifugal separator 315 and extends therefrom to an inlet of an atmosphere-vacuum selector valve 319 which is actuated by a piston and cylinder device. The selector valve 319 has its outlet communicated to an inlet of a second air-driven centrifugal separator 321 located in an upper peripheral portion of the separator. This centrifugal separator 321 is common in type with the first centrifugal separator 315 and has a movable lid 322 for drainage at the lower end thereof. Alternatively, the outlet of the selector valve 319 may be communicated directly to a vacuum blower 320. The centrifugal separator 321 in the illustrated embodiment is connected to the vacuum blower 320 by an outlet duct mounted on the top of the centrifugal separator 321. Furthermore, a silencer 323 is included in the suction system in order to arrest noise. The selector valve 319 comprises a cylindrical housing whose top is open to the atmosphere through an opening 324 and a valve member made up of two opposing pistons connected together by a rod. The lower end of the valve housing is connected with a piston and cylinder device. A piston rod of this piston and cylinder device extends upward into the valve housing and rigidly carries the valve member at its upper end. Thus, the valve member of the selector valve 319 reciprocates vertically within the valve housing in accordance with the action of the piston and cylinder assembly.

Figure 5:
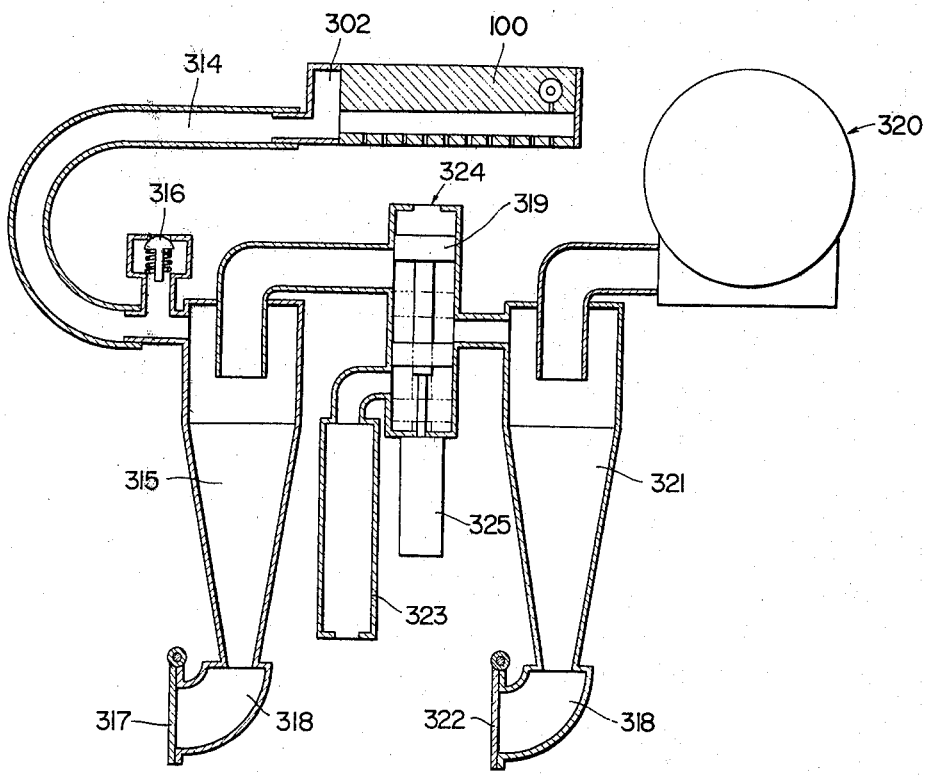
FIG. 5 is a sectional view of a water squeezing suction system associated with the upper mould.
Figure 6:
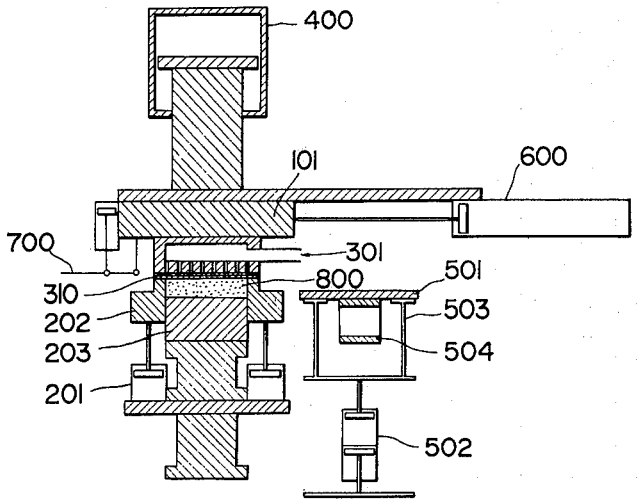
FIGS. 6 to 8 show the operations of another embodiment with a slight modification of FIG. 1 embodiment.

When the valve member 319 assumes a position indicated by a solid line in FIG. 5, the top of the first centrifugal separator will be communicated with the top of the second centrifugal separator 321 connected with the vacuum blower and, therefore, vacuum from the vacuum blower will be communicated to the upper mould 100. As the valve member 319 is shifted to a position indicated by a phantom line, an upper portion of the first separator 315 will become open to the atmosphere through the opening on top of the selector valve 319 while the vacuum from the vacuum blower 320 will be discharged through the silencer 323. The centrifugal separators 315 and 321 have bodies, lower portions of which are tapered. Closure lids 317 and 322 are hinged to the lower ends of the drains 318.

Figure 7:
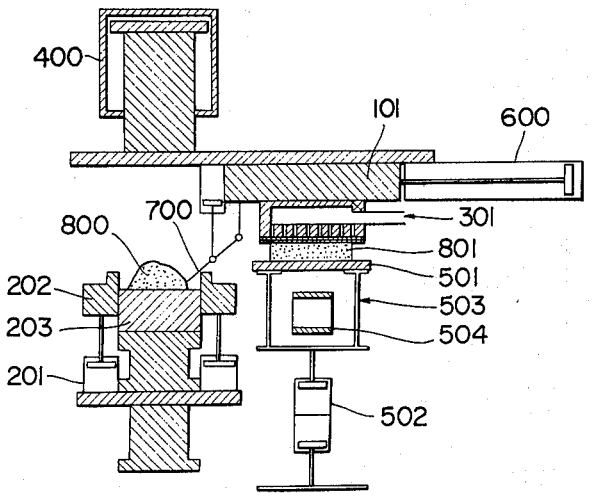
Figure 8:
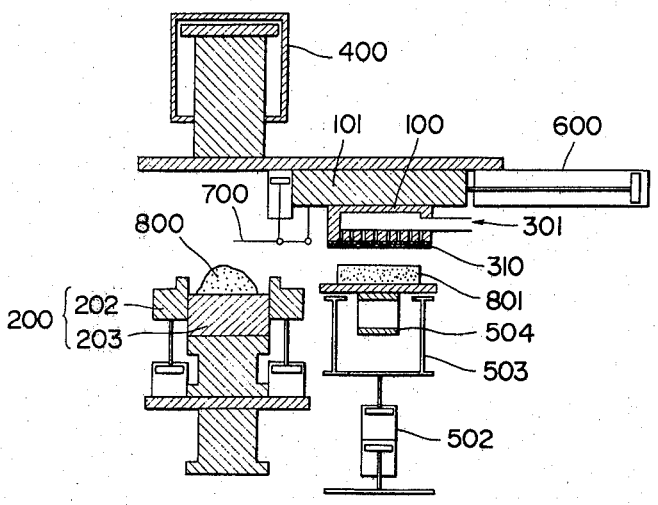
Figure 9:
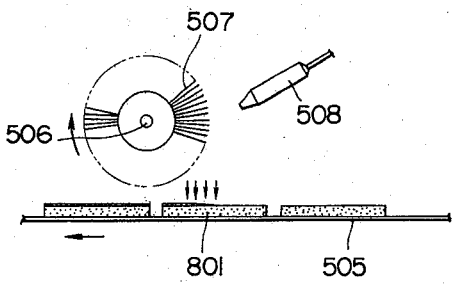
FIG. 9 is a side view of a slurry nozzle and wire brush located above the conveyor belt for feeding mouldings to provide colored finish thereupon.

The present invention facilitates the manufacture of colored mouldings as shown in the following embodiment. In FIGS. 7 to 9, the apparatus includes an upper mould 100 having a vacuum suction opening 301 and carrying a piece of dehydrating cloth 310 and like filtering layers at its bottom. The upper mould 100 is securely mounted on the bottom of a support block 101 on which are also mounted a material feed plate 700 and a piston 600 adapted to cause reciprocative movement of the upper mould. A lower mould 200 is located below the upper mould 100 and fixed in place within a flask 202 which will be actuated by a piston 201 for vertical reciprocation. In operation, the upper mould 100 is brought into intimate contact with the top of the flask 202 held in a raised position and then, with the interior of the flask 202 evacuated, a high pressure press piston 400 is lowered to apply a downward pressure force.

It was revealed that the coloured coating well adheres to the surface of a moulded mass when the latter is formed by specific cloth of suitable synthetic fibers having an air permeation rate of 90 $cm^3$/sec. at a 12.7 mm water columm of pressure differential.

Subsequently, the pressure force from the pressure piston 400 is interrupted to complete a repetitive moulding step and the flask 202 associated with the lower mould 200 is lowered. Then the press piston 400 is moved back to its raised position so that, of the suction due to the vacuum has been maintained through the opening 301, the upper mould 100 moves upward taking the moulded mass upward therewith. Next, the piston 600 pulls the support block 101 horizontally until the upper block 100 on the support block 101 reaches a position directly above an iron receiver plate 501. At this time, the receiver plate 501 is raised to a predetermined position where it will become almost engaged with the bottom of the moulding 801. Under this condition, the suction force acting on the moulding 801 through the upper mould is discommunicated so that the moulding 801 comes off from the upper mould 100 and gently lands on the receiver plate 501.

The upper surface of the moulding 801 now loaded on the receiver plate 501 is the surface having engaged the dehydrater cloth 310 on the upper mould 100. This surface of the moulding is rough due to its contact with the dehydrater cloth 310 and water suction effected through the opening 301, thus being favorable for carrying a colored finish layer which will be sprayed thereonto. Meanwhile, the lower surface of the moulding 801 faced the lower mould 200 will have then been deposited with the mould lubricant. However, coating the lower surface of the moulding is needless since it bears against the receiver plate 501 and forms the back surface of the moulding 801. Stated another way, the use of a mould lubricant for the lower mould 200 is not objectionable in any way for the coating of the moulding 800.

While the upper mould 100 is being carried horizontally by the support block 101 toward the receiver plate 501 as mentioned, a fresh mass of mouldable material 900 is supplied by the material feed plate 700 onto the lower mould 200 (see FIGS. 7 and 8). This will be followed by the repetitive series of operation of the moulding apparatus discussed.

The receiver plate 501 rests on the top of a carriage 502 located above and operatively connected with a vertically reciprocates cylinder assembly 501. As shown, the top of the carriage 503 consists of laterally spaced opposite support surfaces between which a horizontally movable conveyor belt 504 is interposed. With this arrangement, when the cylinder assembly 502 is operated to lower the carriage 503, the receiver plate 501 loaded with the moulding will be transferred automatically from the carriage onto the conveyor belt 504. In the illustrated embodiment, the cylinder assembly 502 for driving the carriage 503 is of a dual stage or double action type made up of two cylinders: one moving the carriage 503 vertically between a first position where it receives a moulding from the upper mould 100 and a second position above the level of the conveyor belt 504 and where it is supplied with a fresh or unloaded receiver plate, and the other causing the carriage to shift vertically between the second position and a third position below the level of the conveyor belt 504 and which is the lowermost position of the carriage.

Figure 10:
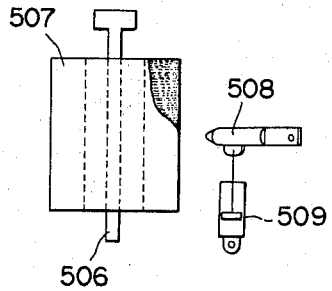
FIG. 10 is a plan view of FIG. 9.

The conveyor belt 504 is immediately followed by a second conveyor belt 505 as viewed in FIG. 9. An apparatus for coating mouldings which the conveyor belt 505 will feed in succession is located above the conveyor belt 505. The coating apparatus may comprise a slurry gun so as to spray paint directly onto the surfaces of mouldings on the conveyor belt 505. However, more effective coating is achieved by the use of a rotary wire brush device schematically shown in FIGS. 9 and 10. The coating device in FIGS. 9 and 10 includes a cylindrical wire brush 507 mounted on a drum and rotatable about a horizontal shaft 506 which is journalled to a framework (not shown) positioned above the path of the belt conveyor 505. The rotational direction of the wire brush 507 is such that its lowermost periphery moves in the same direction as the conveyor belt 505. A slurry nozzle 508 is located ahead of the wire brush 507 with respect to the direction of travel of the conveyor belt 505. This slurry nozzle 508 is inclined downward to have its hole directed toward a point where the horizontal plane containing the axis of the wire brush intersects the circumference of the wire brush adjacent to the nozzle. A cylinder 509 has a piston rod operatively connected to the slurry nozzle 508 in order that the nozzel may be pivotally movable to vary its ejecting direction over the entire axial dimension of the drum of the wire brush.

The conveyor belts 504 and 505 may take the form of a single belt and run continuously at a relatively low rate. Alternatively, the conveyor belts 504 and 505 may comprise separate yet contiguous belts with the latter indexed in synchronism with the cyclic process of forming a moulding 801 at the moulding station.

Referring to FIGS. 11–14, an apparatus according to the present invention includes an upper mould 101 equipped with a vacuum-operated suction arrangement having a suction opening 300. The upper mould 100 carries at its bottom a piece of dehydrating cloth and a wire netting adapted to support the dehydrating cloth. This assembly at the bottom of the upper mould 100 may additionally include an apertured plate in order to promote uniform delivery of a suction force and intercept a moulding material. A reciprocative support table or block 101 has the upper mould 100 securely mounted to its bottom and bears against the underside of a pressure-receiving block 102 at its top. Also mounted on the bottom of the pressure-receiving block 102 is a cylinder 600 in which a piston 602 is slidably received. A piston rod 601 extending from the piston 602 connects the piston with the support block 101 so that the support block 101 slidingly reciprocates along a predetermined path on the bottom of the block 102 from a first or moulding position to a second or product transferring position and vice versa. The pressure-receiving block 102 is rigidly mounted on the frame (not shown) of the apparatus in such a manner as to guide the reciprocative movement of the support block 101 while counteracting a compressive force which will be applied from a high pressure piston and facilitating quick conveyance of a moulding from the moulding position.

A lower mould assembly is disposed below the upper mould 100 and comprises a lower mould 203 and a flask 202 which surrounds and movable vertically relative to the lower mould 202. The lower mould 202 rests on a support block 205 which is in turn seated rigidly on a high pressure press table 207. Secured to the support block 205 or the high pressure press table 207 are a pair of diametrically opposite hydraulic cylinders 201 adapted to move the flask 202 vertically relative to the associated lower mould 200. Each of the hydraulic cylinders 201 has a piston rod 206 connected with the flask 202 for the above purpose. It is permissible to replace the hydraulic cylinder pair 201 by a single hydraulic cylinder installed within the support block 205 and connect it to the flask 202. However, the diametrically opposite arrangement of the hydraulic cylinders 201 is more preferable because it avoids tilting of the lower mould 203 which would yield incomplete mouldings and because it eliminates the need for an additional device for adjusting the thickness of mouldings. A high pressure press 205 comprises a cylinder 208, a piston 209 slidable within the cylinder 208 and a piston rod 210 extending upward from the piston 209 and carrying the press table 207 rigidly at its top. A material feed plate 700 is mounted to the reciprocative support block 101 through a pneumatic cylinder 701 and actuated thereby to reciprocate between a horizontal first position and an inclined second position. While the upper mould 100 is moving together with the support block 101 from the moulding position to the transferring position, the material feed plate 700 will reach a position directly above the lower mould 200 and supply the lower mould with a predetermined constant amount of a mouldable material 900.

The high pressure press drives the lower mould assembly 202 and 203 vertically relative to the upper mould 100 in the moulding position. A belt conveyor may be located in the transferring position so as to promote quick conveyance of mouldings. In the illustrated embodiment, a conveyor belt 504 extends through the transferring position and runs along a horizontal path which is parallel to a line perpendicular to the axis of the piston rod 601 on the upper support block 101. Obviously, the travelling path of the conveyor belt 504 may be designed in parallel with the reciprocative path of the support block 101 on the pressure-receiving block 102. The conveyor belt 504 is interposed between horizontally spaced upper opposite surfaces of a carriage 503 which is vertically movable in the transferring position. A receiver plate 501 made of iron rests on the spaced upper surfaces of the carriage 503. The lower end of the carriage 503 is operatively connected with a cylinder assembly 502 having upper and lower cylinder chambers 510 and 511 and displacing the receiver plate 501 vertically in two different stages. More specifically, the cylinder 502 will cause the receiver plate 501 to selectively assume the uppermost position where it will receive a product, the lowermost position where the product will be transferred onto the conveyor belt 504, and a stand-by position intermediate the uppermost and lowermost positions and where it will be supplied with a new or unloaded receiver plate 501.

Figure 11:
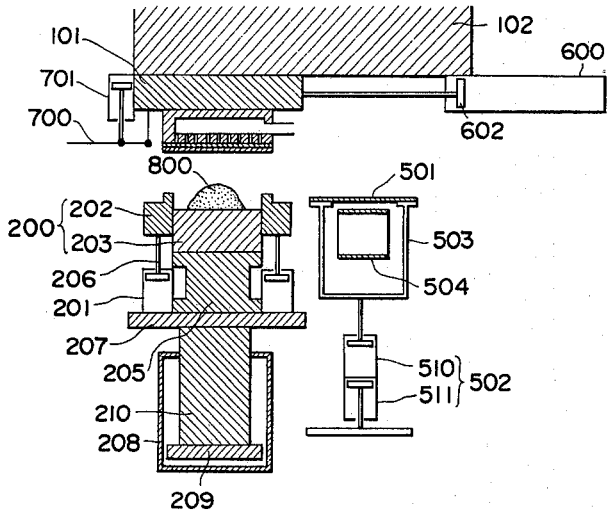
FIGS. 11 to 14 show the operation of a further embodiment of the invention.
Figure 12:
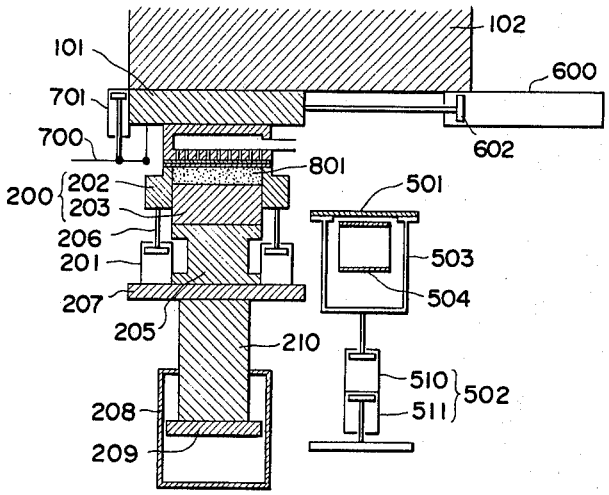

The apparatus having the above construction will be operated as follows. FIG. 11 represents an initial step of a repetitive cycle for forming a tile or like moulding out of cement mortar. In this situation, the lower mould 200 is loaded with a predetermined amount of mouldable material while the high pressure press piston 209 assumes a lowered position, the flask 202 associated with the lower mould a raised position, and the upper mould 100 the moulding position. The receiver plate 501 is in the stand-by position intermediate the uppermost and lowermost positions. Then, as shown in FIG. 12, the piston 209 is raised to apply a pressure force such that the lower mould assembly 202, 203 is engaged with the upper mould 100 to compress the mortar 800 therebetween. Simultaneously, the suction device on the upper mould 100 is activated to start squeezing water out of the mortar. The suction force keeps on acting on the thus compressed and dehydrated mass even after the full forming. In the meantime, the cylinders 201 move the lower mould flask 202 downward and then the high pressure cylinder 208 lowers the lower mould assembly 200. The moulding is released from the lower mould assembly but still held on the upper mould by the suction applied thereto through the suction arrangement. Immediately after the release of the lower mould from the moulding, the cylinder 600 can operate to displace the upper mould 100 loaded with the moulding from the moulding position to the transferring position. This offers a 20–30% reduction in the time period necessary for such a displacement compared with the case wherein the upper mould 100 is secured to a high pressure piston and moved vertically thereby.

Figure 13:
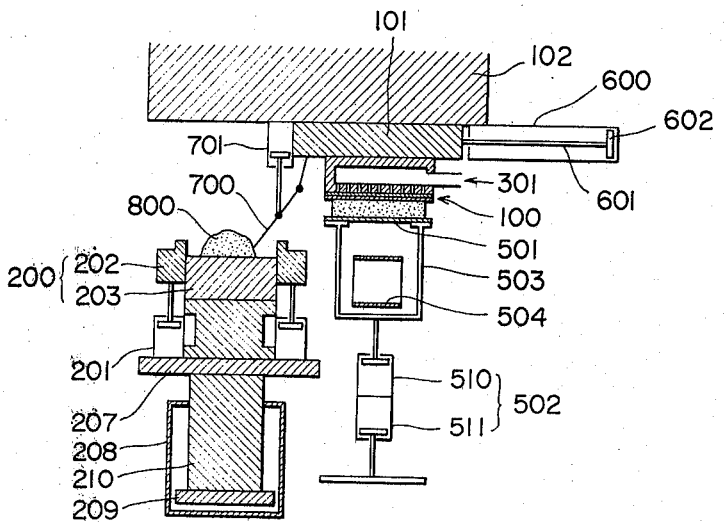
Figure 14:
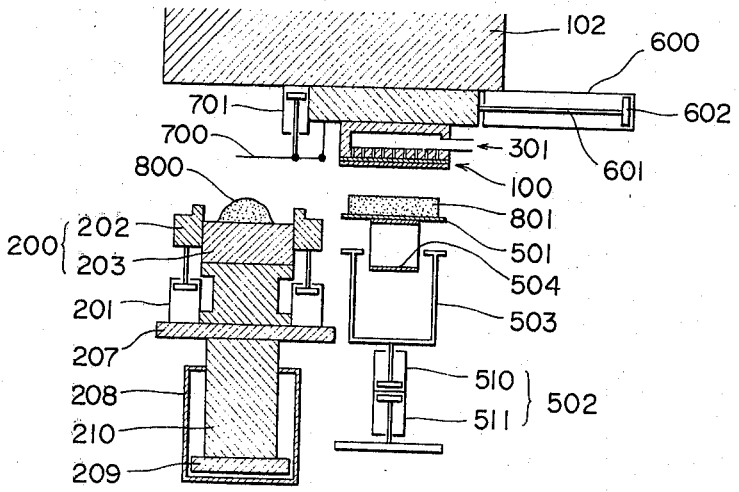

As the upper mould 100 arrives at the transferring position, the carriage 503 is raised until the receiver plate 501 seated thereon becomes almost engaged with the bottom of the moulding as indicated in FIG. 13. At this time, the vacuum acting on the moulding is discommunicated allowing the moulding to land softly on the receiver plate 501. The material feed plate 700 on the other hand is moved by the cylinder 701 to its inclined position and loads the lower mould 200 with another volume of mouldable material 900. Subsequently, as viewed in FIG. 14, the carriage 503 is moved downward to transfer the loaded receiver plate 501 onto the conveyor belt 504 and further downward to the lowermost position past the conveyor belt 504. In the cylinder assembly 502 illustrated, the upper piston causes vertical movement of the carriage 503 between the stand-by position and product receiving position whereas the lower piston moves the carriage between the stand-by position and lowermost position. As will be seen, the loaded receiver plate 501 is layed on the conveyor belt 504 in the course of the downward movement of the carriage 503 from the stand-by position level to the lowermost. Finally, the carriage 503 now unloaded is moved upward to the stand-by position shown in FIG. 13. This completes a cycle according to the present invention.

Figure 15:
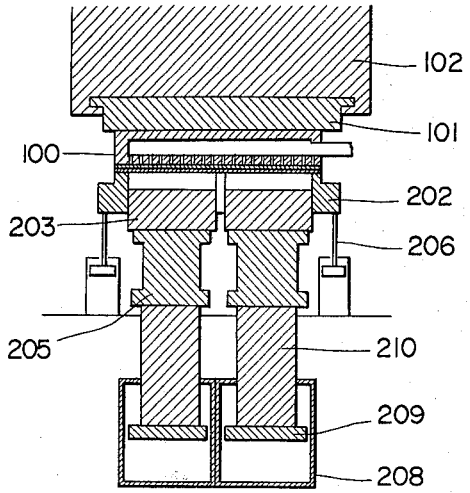
FIG. 15 is a sectional front view of a still further embodiment.

FIG. 15 depicts an alternative embodiment of the present invention designed to operate two sets of upper and lower moulds at the same time. As shown, the apparatus comprises a single stationary upper mould 100 having two different mould parts formed thereon. These two upper mould parts confront a pair of complementary lower mould assemblies which have individual lower mould bodies 203 and a common flask 202 surrounding the lower moulds 200. The flask 202 moves vertically relative to the independent lower moulds 203. Separate high pressure pistons 209 are individually alloted to the lower moulds 203 to compress mouldable masses into mouldings. Though two independent lower moulds 200 may be operated by a single high pressure press, this will make the accuracy of measurement poor when a mouldable material is to be supplied to the lower moulds 200. Two cylinders suffice for the common flask 202 to prepare two mouldings simultaneously with improved accuracy. Two mouldings fully formed and adhered to the upper mould 100 by suction will be conveyed in a parallel relation by the reciprocative support block 101 as soon as the lower moulds 203 detaches from the mouldings and will then be transferred onto a conveyor belt located at the product transferring end.

Figure 16:
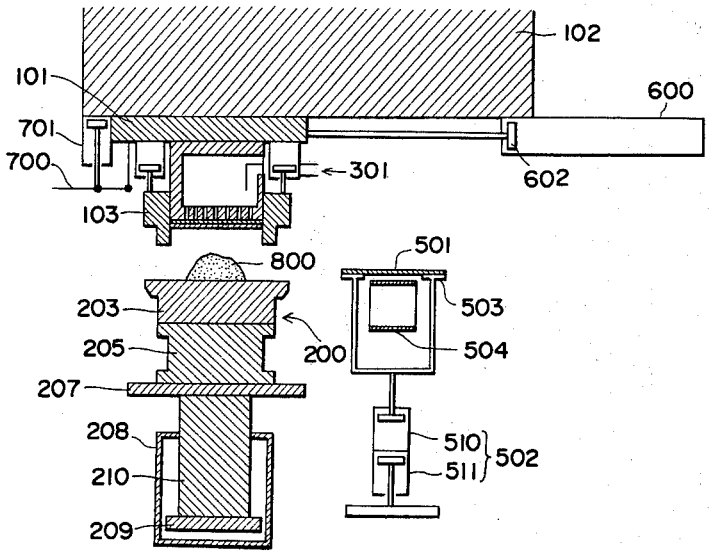
FIGS. 16 to 20 show the operation of a still further embodiment.
Figure 17:
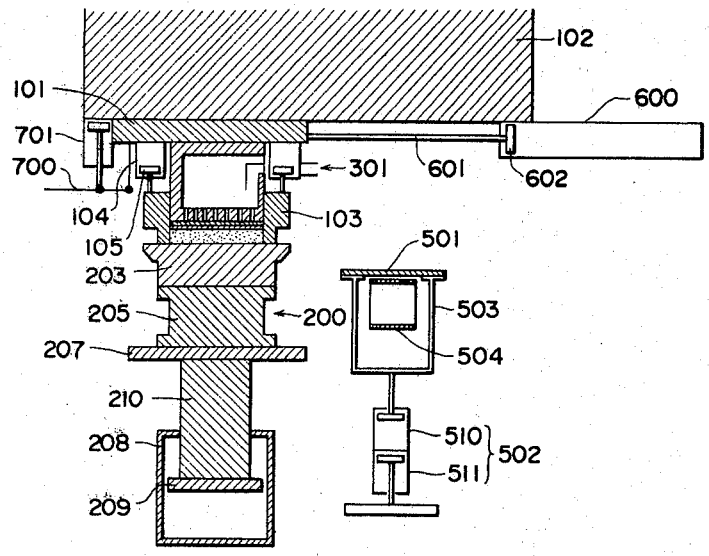

A further embodiment of the present invention is shown in FIG. 16 which has a flask 103 associated with an upper mould assembly 100. This type of arrangement permits a colored finished material to be loaded in an internal auxiliary mould. The flask 103 is vertically movable relative to the upper mould 100 by cylinders 104 and their pistons 105 located above the upper mould 100. It will be seen that the illustrated apparatus needs be furnished with a somewhat intricate arrangement for the delivery of a suction force because the suction opening 302 cannot be positioned on the surface of the upper mould 100 on which the flask 103 slides and, therefore, must be located above said surface.

Referring to FIGS. 16–20, a still further embodiment of the present invention is illustrated. As shown, the apparatus includes an upper mould 100 provided with a vacuum-operated suction arrangement having a suction opening 302. This suction arrangement serves in squeezing water out of a mouldable material and conveying a moulded mass as will appear. Mounted on the bottom of the upper mould 100 is a filter assembly consisting of a dehydrating piece of cloth and a wire netting adapted to support the dehydrater cloth. The filter assembly may additionally include an apertured plate in order to establish even delivery of a suction force and intercept a mouldable material which will form products. A horizontally reciprocative support block 101 slidably engages with the bottom of a pressure receiving plate or block 102 at its top and carries the upper mould 100 at its underside. A piston 602 is slidably received in a cylinder 600 mounted on the block 102 and connected by a piston rod 601 to the confronting end of the support block 101, so that the support block 101 is moved by the piston 600 between a moulding position and a delivering position on and along the block 102. The pressure receiving block 102 is rigidly mounted to the framework (not shown) of the apparatus to guide the reciprocation of the support block 101 and counteracts a compressive force which a high pressure press piston will exert during moulding operation. Also, the block 102 promotes quick conveyance of a moulding after the moulding has been formed.

A flask 103 surrounds the upper mould 100 and moves up and down relative to the upper mould. Hydraulic cylinders 104 are mounted to a base portion provided in an upper section of the upper mould 100. Pistons 105 are slidably accommodated in the hydraulic cylinders 104 while piston rods extend from the individual pistons 105 downward to connect with the flask 103.

The apparatus also includes a lower mould 200 seated on a support block 205. Due to the absence of a flask, the lower mould 203 has a relatively wide flat top. If desired, a flange or a skirt may surround the top of the lower mould 203 to further increase its area compared with conventional one. A high pressure press is shown to comprise a cylinder 208, a piston 209 slidable within the cylinder 208, a piston rod 210 extending upward from the piston 209, and a table 207 fixed on the upper end of the piston rod 210. The lower mould support block 205 is rigid on the top of the high pressure press table 207. A pneumatic cylinder 701 is mounted on the reciprocative support block 101 and actuates a material feeding plate 700 through its associated piston and piston rod such that the plate 700 swings between a horizontal position and an inclined position. While the upper mould is moving from the moulding position to the delivering position, the material feeding plate 700 will reach a position directly above the lower mould 203 to load a determined amount of mouldable material 800 on the lower mould.

The mouldable material 800 is supplied onto the lower mould 200 which has been applied with a mould lubricant. Alternatively, use may be made of an auxiliary mould placed on the lower mould 200. The auxiliary mould when employed would be moved by the upper mould 100 together with a moulding after compressing the mouldable material in cooperation with the upper mould.

While the lower mould 203 reciprocates vertically in the moulding position relative to the upper mould, a belt conveyor may be located in the delivering position to promote quick transfer of mouldings. A delivering device shown in the drawings comprises a conveyor belt 504 which traverses the delivering position in a horizontal plane and extends in parallel with a line perpendicular to the axis of the piston rod 601 connected with the support block 101. Obviously, the travelling path of the conveyor belt 504 may extend in parallel with the moving direction of the support block 101. The conveyor belt 504 is interposed between laterally spaced opposite upper surfaces of a carriage 503 whose lower end is connected to a cylinder 502. A receiver plate 501 made of iron is detachably layed on the top of the carriage 503. In the illustrated embodiment, the cylinder 502 has upper and lower cylinder chambers 510 and 511 so as to vertically move the carriage 503 in two different stages. More specifically, the cylinder 502 allows the carriage 503 to assume three different vertical positions: a first or uppermost position for receiving a moulding, a second or lowermost position past of a level where it will shift the moulding onto the conveyor belt 504, and a third position intermediate between the first and second positions and where it will be loaded with an unloaded new receiver plate 501.

The apparatus having the above construction will be operated as follows to produce tiles or like mouldings of cement mortar. FIG. 16 shows an initial stage of a repetitive moulding operation in which the lower mould 200 has been loaded with a measured constant amount of mouldable material 800. The press piston 209 is in a lower position, the upper mould 100 in the moulding position and the receiver plate 501 in the intermediate stand-by position. From this position, the press piston 209 is raised to exert a pressure force so that the lower mould 203 pressingly engages with the upper mould 100 as viewed in FIG. 17. The mouldable material 800 is then compressed between the upper and lower moulds while the vacuum-operated suction device on the upper mould 100 is actuated to start squeezing water out of the mouldable material. A moulding prepared by the compression and dehydration is kept supported on the bottom of the lower mould by the suction force even after the forming process is completed. In the meantime, the cylinder 104 raises the flask 102 associated with the upper mould 100 and then the press cylinder 208 lowers the lower mould 100. This causes the moulding to disengage from the lower mould while being retained on the upper mould with or without an auxiliary mould by the suction force acting through the suction arrangement. Just after the moulding becomes disengaged from the lower mould, the cylinder 600 on the block 102 is activated to shift the upper mould 100 and therefore the moulding from the moulding position to the delivering position. This type of construction achieves a 20–30% cut-down in necessary time period compared with a traditional apparatus having an upper mould which is secured to a high pressure press piston and movable vertically relative to a lower mould.

Figure 18:
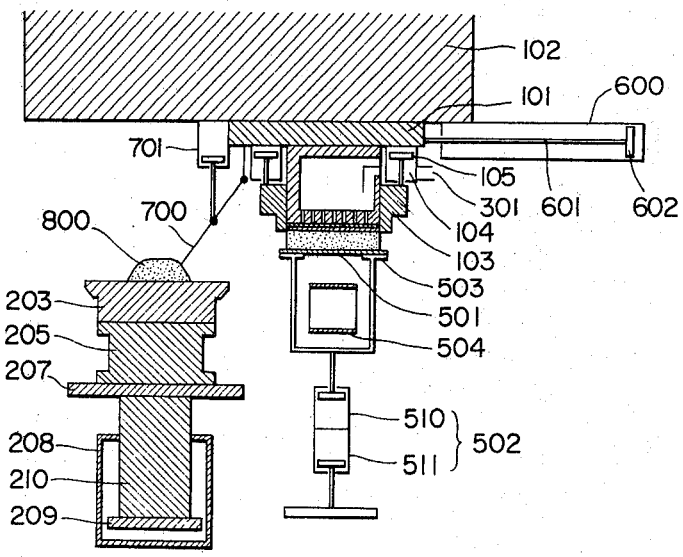
Figure 19:
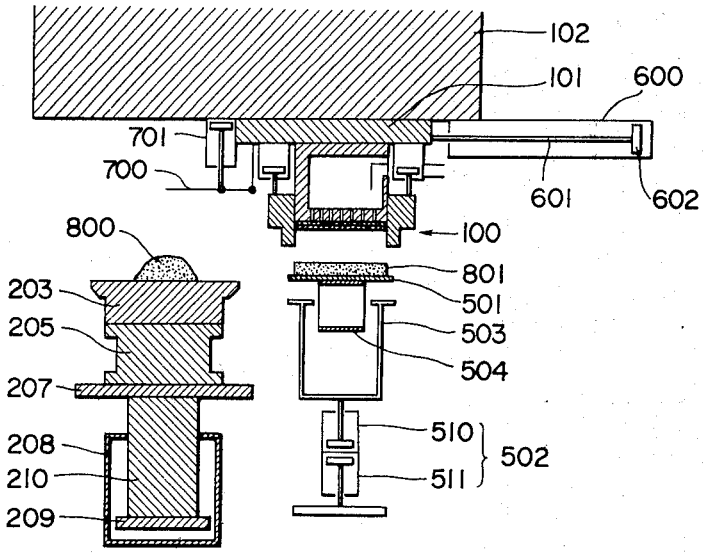

FIG. 18 represents a situation wherein the upper mould 100 has moved from the moulding position to the delivering position and the carriage 503 has rised to bring the receiver plate 501 to a position quite close to the moulding on the upper mould 100. Then the suction device on the upper mould 100 is deactivated so that the moulding detaches the upper mould 100 and softly lands on the receiver plate 501. In the meantime, the cylinder 701 tilts the material feeding plate 700 to load a measured amount of mouldable material 800 on the lower mould. The carriage 503 keeps on moving downward as shown in FIG. 19 and stops its movement after laying the receiver plate 501 on the conveyor belt 504 which is in operation. Of the two pistons in the cylinder 502, one in the upper chamber 510 moves the carriage 503 between the intermediate stand-by position and uppermost receiving position whereas one in the lower chamber 511 moves it between the intermediate position and lowermost position. It will be seen that the transfer of the loaded receiver plate 501 from the carriage 503 to the conveyor belt 504 occurs during the movement of the carriage from the intermediate position to the lowermost position. Thereafter, the carriage 503 returns to the position depicted in FIG. 16 and the carriage 503 is supplied with an unloaded fresh receiver plate 501. This is the end of a repetitive cycle of the apparatus.

Figure 20:
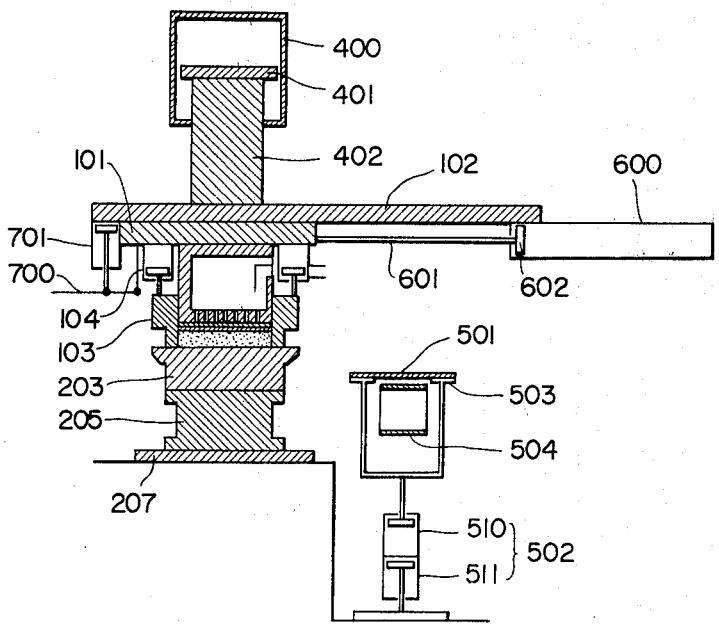

Turning to FIG. 20, there is shown another embodiment of the present invention in which the upper mould reciprocates vertically relative to the lower mould 203 secured to a rigid support portion of the apparatus. A cylinder 400 of a high pressure piston is rigidly mounted to the framework of the apparatus and has a piston 401 slidably accommodated therein. A piston rod 402 extends downward from the press piston 401 and protrudes from the lower end of the press cylinder 400. The piston rod 402 carries at its lower end the pressure receiving plate 102 on and along which the table 101 carrying the upper mould 100 therewith slides through a horizontal path.

Figure 21:
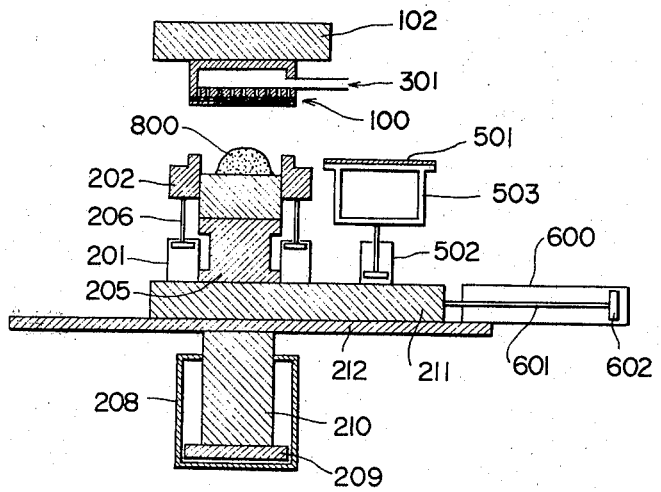
FIGS. 21 to 24 show the operation of a still further embodiment.
Figure 25:
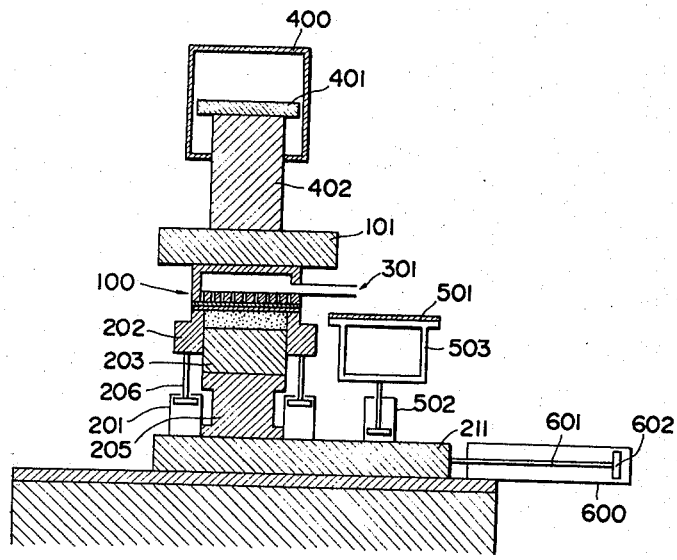
FIG. 25 shows a still further embodiment of the invention.

Referring to FIGS. 21 and 25, a still further embodiment is shown to include an uper mould 100 having a vacuum-operated suction arrangement which includes a suction opening 302. This suction arrangement serves in squeezing water out of a mouldable material and supporting a moulded mass as will appear. Mounted on the bottom of the upper mould 100 is a filter assembly consisting of a dehydrating piece of cloth and a wire netting adapted to support the dehydrating cloth. The filter assembly may additionally include an apertured plate in order to establish even delivery of a suction force and intercept a material which will form products. A pressure receiving plate or block 102 is rigidly mounted to the framework of the apparatus and in turn securely supports the upper mould 100 on its underside. Thus, the upper mould counteracts a compressive force which a high pressure press piston will exert during moulding operation. As will become apparent, this apparatus needs no structural designs for moving the upper mould 100 horizontally and thus promotes the ease of manufacture and assemblage compared with conventional one in which an upper mould having an intricate structure and equipped with a suction device moves both vertically and horizontally.

The reference numeral 203 denotes a lower mould body which constitutes a lower mould assembly together with a flask 202. This flask 202 surrounds the lower mould body 203 and moves vertically relative to the lower mould. The lower mould 203 rests on a support block 205 which is fixed in place on a horizontally reciprocative table 211. Hydraulic cylinders 201 are secured to the support block 205 or table 211 in diametrically opposite positions. Piston rods 206 extend upward from the individual cylinders 201 to operatively support the flask 202 at their upper ends. Alternatively, a single hydraulic cylinder may be disposed within the support block 205 instead of the cylinders 201. The opposite locations of two cylinders with respect to a diameter of the support block 205 is more favorable because it avoids tilting of the lower mould assembly which would result incomplete mouldings and unnecessitates a device for adjusting the thickness of mouldings. A high pressure press comprises a cylinder 208, a piston 209 slidable within the cylinder 208, a piston rod 210 extending upward from the piston 209 and a table 212. The table 211 is slidable on and along the top of the press table 212 through a predetermined horizontal path.

A cylinder 600 is mounted securely and horizontally on the right end of the press table 212 as viewed in the drawings. Disposed slidably in this cylinder 600 is a piston 602 which connects through a piston rod 601 to the confronting end of the table 211. The piston 602 moves the table 211 between a moulding position and a product transferring position in accordance with its reciprocation within the cylinder 600.

A carriage 503 is positioned adjacent to the lower mould support block 205 and mounted vertically movably on the table 211 through a cylinder 502. A receiver plate 503 made of iron is constantly supplied to and layed on the top of the carriage 503. The table 211 driven horizontally by the piston 602 will bring the lower mould 203 and carriage 503 alternately into vertical registry with the upper mould 100.

Figure 24:
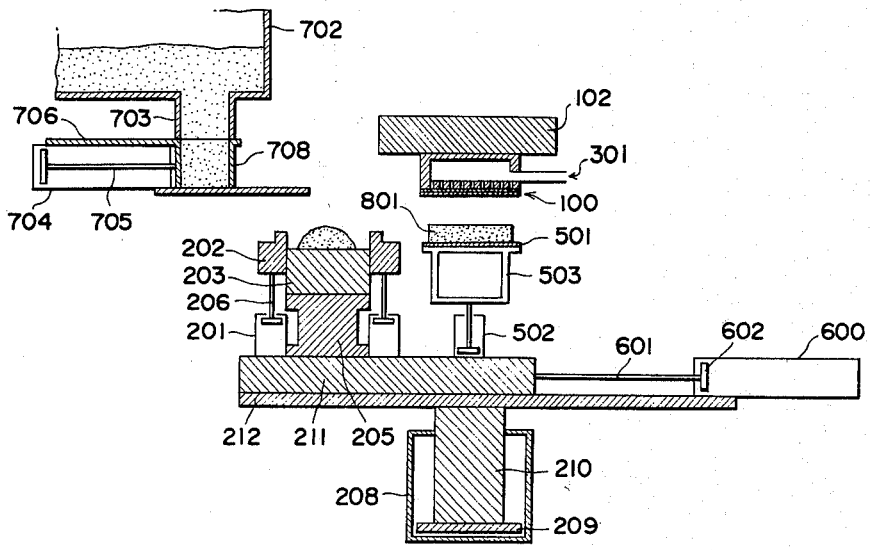

When the carriage 503 is moved by the table 211 to the position directly below the upper mould 100, the lower mould body 20 will in turn align with a device 31 adapted to load the lower mould body 203 with a measured amount of a mouldable material. Having openings at its top and bottom, the loading device 701 is connected through a piston rod 705 to a piston slidable in a cylinder 704 which is secured to a rigid support plate 707. A horizontal stop plate 706 extends from upper end of the loading device 701 as illustrated. The reference numeral 702 denotes a container storing a mouldable material therein and having a discharge opening 703. By the actions of the cylinder 704, the loading device 701 slides on the plate 707 between a first position where it is vertically aligned with the opening 703 of the container 702 and filled with the mouldable material (FIG. 24) and a second position where it is aligned with the lower mould body 203 and supplies a given amount of mouldable material to the lower mould due to gravity. The stop plate 706 will close the opening 703 of the container 702 when the loading device 701 is substantially out of the first position. The rigid support plate 707 on the other hand will keep the bottom opening of the device 701 closed except for the case wherein the device 701 is substantially in its second position.

Figure 22:
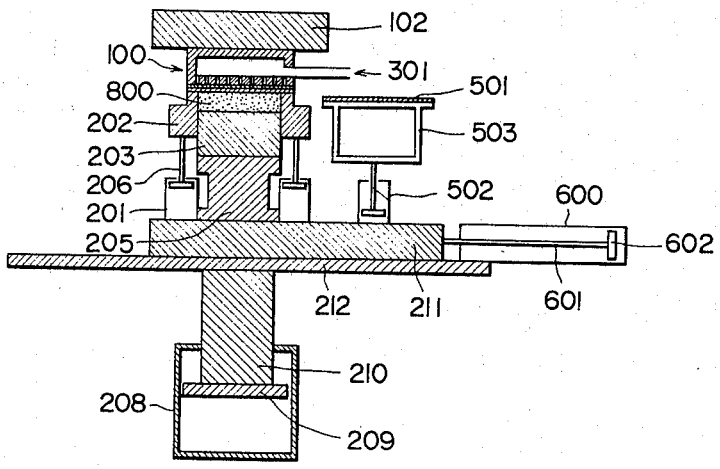

The apparatus having the above construction will be operated as follows to produce tiles or like mouldings of cement mortar. FIG. 21 shows an initial stage of a repetitive moulding operation in which the lower mould 503 loaded with a mass of mouldable material 900 is vertically aligned with the upper mould. In this situation, the press piston 209 is in a lowered position, the flask 202 associated with the lower mould 203 in a raised position, and the upper mould 100 in a moulding position. From this position, the press piston 209 is raised to force the lower mould assembly 202 and 203 into pressing engagement with the upper mould 100 as viewed in FIG. 22. The mouldable material 900 on the lower mould body 203 is thus compressed by the force exerted by the high pressure press while, at the same time, the suction arrangement on the upper mould 100 is activated to squeeze water out of the mouldable mass. A moulding prepared by the compression and dehydration is kept supported on the bottom of the lower mould by the suction force even after the forming process is completed. In the meantime, the cylinders 201 lower the flask 202 and then the cylinder 208 bodily lowers the lower mould assembly 200. As the lower mould assembly 200 detaches the moulding sucked onto the upper mould 100, the cylinder 600 is actuated to move the table 211 horizontally until the lower mould assembly 200 reaches its material loading position and the carriage 503 a product receiving position vertically aligned with the upper mould 100 as viewed in FIG. 23.

Figure 23:
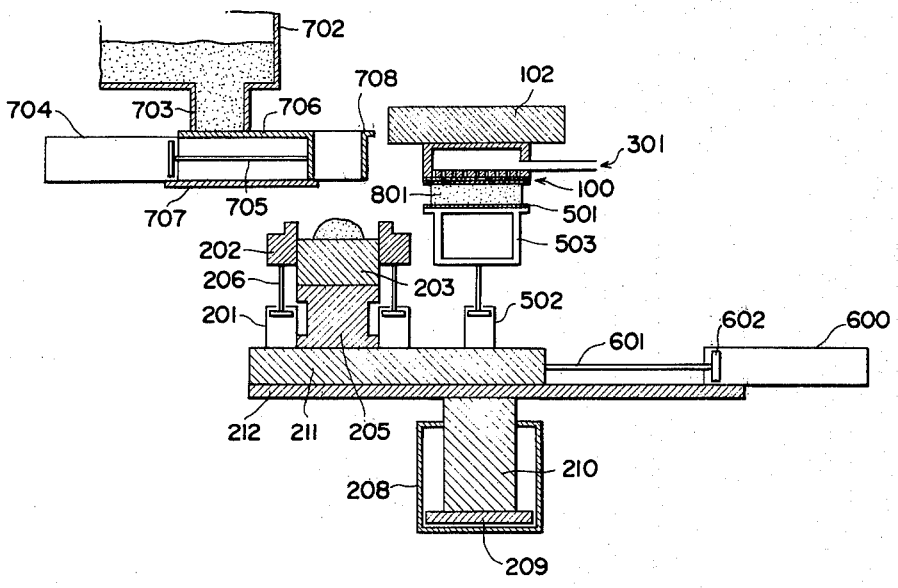

Meanwhile, the cylinder 502 raises the carriage 503 to a level where the receiver plate 501 atop of the carriage 503 becomes almost engaged with the moulding 801 as also shown in FIG. 23. When the vacuum communicated to the suction arrangement on the upper mould 100 is interrupted so that the moulding 801 softly lands on the receiver plate 501. The lower mould assembly on the other hand is loaded with a fresh measured volume of mouldable material from the loading device 701 which will have then been moved by the piston rod 705 into alignment with the lower mould assembly; the mouldable material has been filled in the device 701 from the container 702 in the manner shown in FIG. 24. Subsequently, the carriage 503 is lowered with the loaded receiver plate 501 layed thereon as viewed in FIG. 24 whereafter the receiver plate 501 is transferred to a determined curing station via a separate path while carrying the moulding 801 thereon. A belt conveyor may be located adjacent to the carriage mechanism such that the loaded receiver plate 501 is automatically shifted onto the belt conveyor in the course of the downward movement of the carriage 503. The carriage 503 now unloaded regains the lowermost or stand-by position indicated in FIG. 21 and then supplied with another or empty receiver plate 501. This is the end of a repetitive cycle of the apparatus.

A still further embodiment is illustrated in FIG. 25. In this case, the upper mould 100 is driven by a high pressure press for vertical reciprocation while the lower mould assembly 200 reciprocates only horizontally between the material loading position and moulding position. As shown, a high pressure press cylinder 400 is rigidly mounted to the framework of the apparatus and has a piston 401 slidable vertically therein. A piston rod 402 extends from the piston 401 to project from the lower end of the cylinder 400. The upper mould is securely mounted on the support block 101 which is in turn secured to the lower end of the piston rod 402.

This structure does not incorporate horizontal movement of the upper mould which is associated with the vacuum suction arrangement, eliminating the need for a complicated design of the high pressure press cylinder and the vacuum suction arrangement and assuring reliability of the device.

Figure 26:
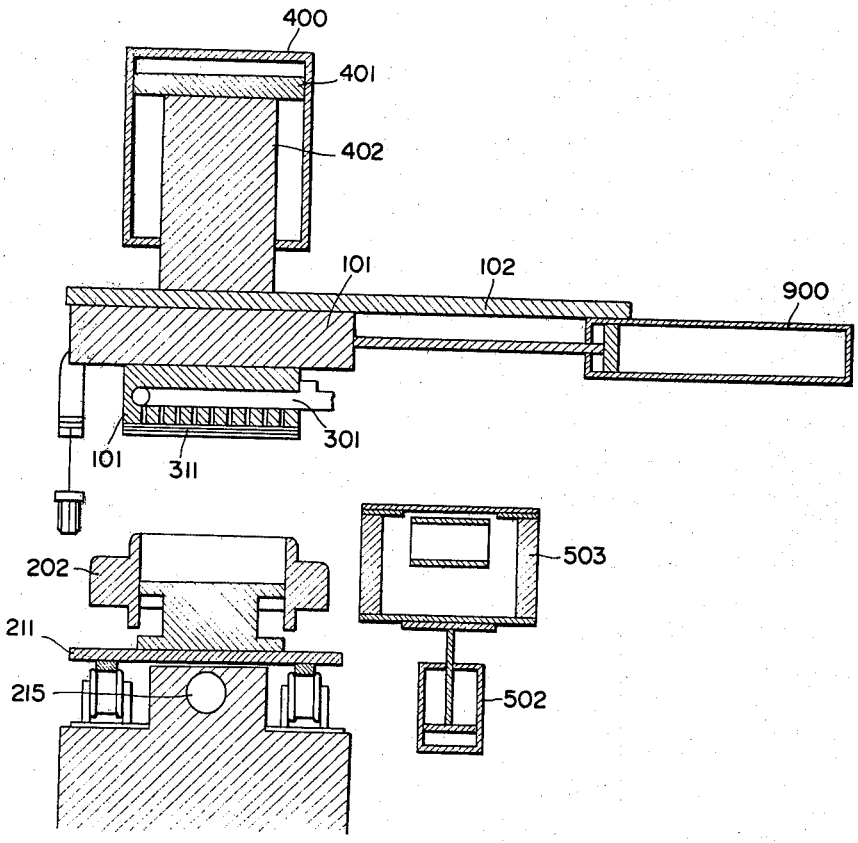
FIG. 26 is a sectional front view of a still further embodiment.
Figure 27:
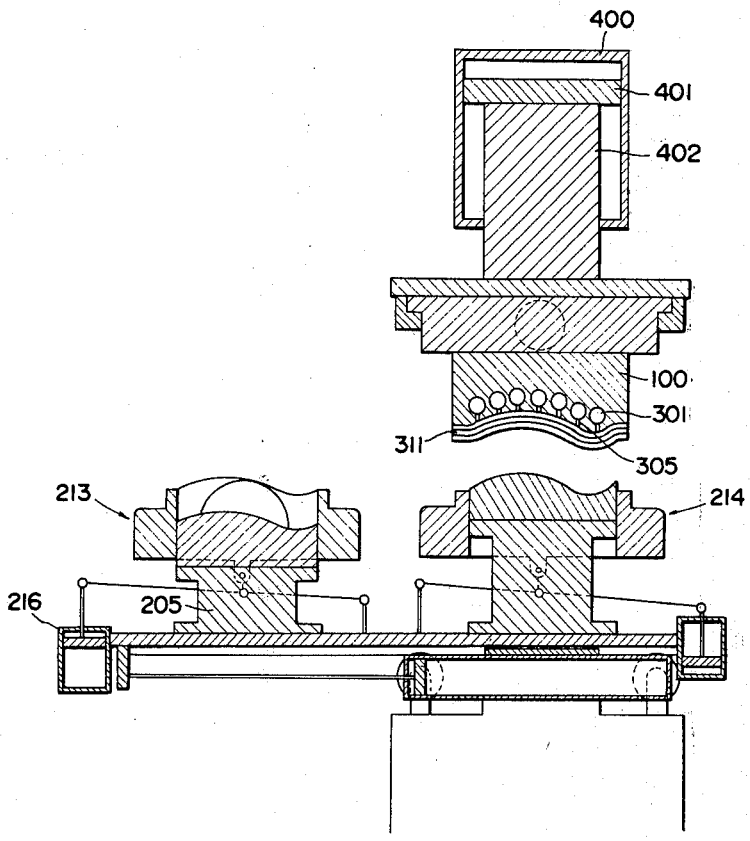
FIG. 27 is a sectional side view of FIG. 26.

As best shown in FIG. 26, the apparatus includes a high pressure press cylinder 400 in which a high pressure press piston 401 is slidable for vertical reciprocation. A piston rod 402 extends downwardly from the press piston 401 and rigidly carries an upper table 102 at its lower end. The upper table 102 in turn carries on its underside an upper mould support block 101 which is operatively connected with a cylinder 900 to be moved thereby along a horizontal path on the upper table 102. An upper mould 100 is rigid on the bottom of the support block 101 and has the lower surface thereof shaped to be identical with the lower surface configuration of desired mouldings such as tiles. A plurality of suction channels 308 extend vertically through the upper mould 100 from its lower surface to individual ducts 301 which are adapted to communicate the channels through a suction manifold 302 to a vacuum blower (not shown) serving the supply of vacuum. Fastened as by clasps to the bottom of the upper mould 100 is a filter plate assembly 311 made up of a draining plate 312 made of iron, a wire netting 309 and a piece of dehydrating cloth 310. The press head with the press cylinder 400 mounted thereto also has a lower table 211 in a lower portion thereof. As best shown in FIG. 27, the lower table 211 is movable along a horizontal path spaced vertically from and perpendicular to the horizontal path which the support block 101 operated by the cylinder 900 moves. First and second lower moulds 100 and 200 are seated on the top of the lower table 211 to serve individual functions as will be discussed. The lower table 211 will be driven for horizontal reciprocation by a hydraulic cylinder 215 such that the two lower moulds 213 and 214 alternatly align vertically with the upper mould 100.

The first lower mould 213 which is for preliminary forming comprises a base 205 mounted on the lower table 211, a mould body 203 on the base 205 and a flask 202 surrounding the mould body 203 and selectively moved up and down by a hydraulic actuator 216. Likewise, the second lower mould 214 for finishing with a coloring material has a base 205 on the table 211, a mould body 203' on the base 205' and a flask 202' surrounding the mould body 203' and moved vertically by a hydraulic actuator 217. Obviously, each of the lower mould bodies 203 and 203' may be so designed that the base and flask remain stationary while the associated mould body moves vertically relative thereto in accordance with the movement of any suitable actuator, e.g. a hydraulic cylinder.

Operated by the cylinder 900, the upper mould 100 is capable of horizontal movement between a first position where it aligns with the lower mould 213 or 214 and a second position where it aligns with a vertically movable support mechanism 503 for a receiver plate of iron (see FIG. 26). The reference numeral 700 designates a device for loading the pre-forming mould 213 with a measured constant amount of a mouldable material.

Figure 28:
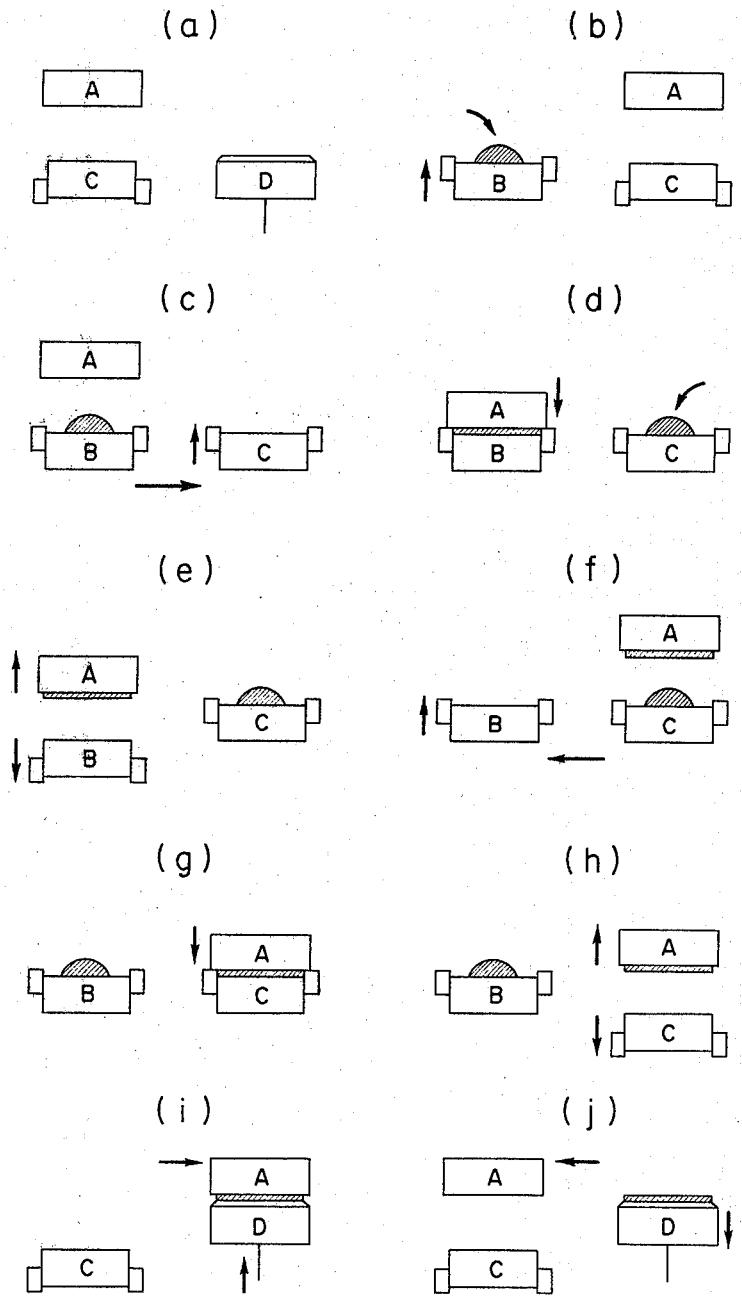
FIG. 28 shows a sequence of the steps performed in the operation of the embodiment of FIG. 26.

The apparatus having the above construction will undergo a series of steps (a)–(j) shown in FIG. 28 which constitute one cycle for preparing a desired colored moulding of cement mortar. The reference characters A, B, C and D in FIG. 28 denote the upper mould, pre-forming lower mould, finishing lower mould and receiver plate support, respectively; arrows indicate moving directions of the elements A–D and those of the flasks associated with the lower moulds.

Referring to FIG. 28, step (a) represents an initial position of the apparatus in a forming cycle. From this position, the flask of the pre-forming lower mould B is raised and the measuring device supplies a predetermined amount of cement mortar onto the lower mould B as shown in step (b). Then the lower table supporting the lower moulds B and C moves horizontally until, as in step (c), the lower mould B aligns vertically with the upper mould A; at this instant, the flask of the finishing lower mould C is raised. In step (d), the upper mould A is lowered to compress the cement mortar in cooperation with the aligned lower mould B while squeezing water out therefrom and, at the same time, a coloring material is fed onto the lower mould C. This is a preliminary forming step which prepares an underlying layer of block of cement mortar. Thereafter, in step (e), the flask of the lower mould B is lowered and the press piston moves upward raising the upper mould A away from the lower mould B. In this upward movement, the upper mould A takes the semi-formed moulding therewith due to the vacuum communicated thereto by the vacuum blower as discussed. The lower table is then shifted horizontally until the finishing lower mould C is brought into registry with the upper mould A as shown in step (f). Under this condition, the upper mould A is lowered onto the lower mould C as seen in step (g) so that the semi-formed moulding on the upper mould A is fully formed under compression and colored by pressing and stretching the colored finishing material on the surfaces of the lower mould. In the next step (h), the flask of the lower mould C is lowered and the press piston is raised causing the upper mould A to rise with the finished moulding still adhered thereto. This is followed by step (i) in which the upper mould A moves horizontally along the path perpendicular to the path of the lower table and into alignment with the receiver plate support D. Then a receiver plate is moved upwardly by its support D and stopped at a position adjacent to the lower surface of the finished moulding. At this instant, the vacuum applying a suction force to the finished moulding is discommunicated so that the moulding softly comes off the the dehydrater cloth of the filter assembly and lands gently on the receiver plate without being deformed or damaged at all. In the final step (j), the unloaded upper mould A moves back to the initial or forming position along the upper table while the receiver plate now loaded with the finished moulding is conveyed to a preselected curing station by a separate transfer system and an unloaded or empty receiver plate is brought to the loading position the first or full receiver has assumed. The apparatus will thereafter repeat this forming cycle going back to the first step (a). Experiments showed that one forming cycle needs 13 seconds and that the time interval between two successive cycles is negligible.

What is claimed is:

1. A method of producing cement mortar mouldings comprising the steps of:

(a) supplying cement mortar material onto a lower mould at a first position;

(b) bringing said lower mould into a vertical alignment with an upper mould at a second position;

(c) pressing both upper and lower moulds to each other by means of a high-pressure press cylinder to compress said cement mortar material therebetween into a moulding;

(d) dehydrating said compressed material by subjecting the same to suction through filtering means including a drainer plate from above;

(e) separating the lower mould from the moulding while maintaining said suction to retain the moulding on the upper mould;

(f) bringing the upper mould into a vertical alignment with a conveyor;

(g) contacting the upper mould and the conveyor;

(h) stopping the suction to land the moulding onto the conveyor; and (i) restoring the upper mould to the first position.

2. A method according to claim 1 further comprising the step of coloring the moulding landed on the carriage between the steps (h) and (i).

3. An apparatus for producing cement mortar mouldings comprising:

an upper mould and a lower mould, either one of said moulds being adapted to move toward and away from the other such that both moulds take open and closed positions, said lower mould being adapted to receive a measured amount of wet cement mortar and the upper and lower moulds take said open position;

suction section provided in association with said upper mould to suck water from the wet cement mortar, said filter means including a drainer plate having a plurality of perforations therein and attached to a lower section of the upper mould, a wire net attached to an underside of said drainer plate and a sheet of filtering cloth attached to an underside of the wire net.

4. An apparatus according to claim 3, wherein said suction section includes a plurality of parallel water passages laterally extending in said upper mould and communication with a vacuum source at one end thereof; and an air suction pipe extending in the upper mould perpendicularly to said water passages and being in communication with both atmosphere and said water passages.

5. An apparatus according to claim 4, wherein said air suction pipe is inserted with a water supply pipe.

6. An apparatus according to claim 3, wherein said lower mould is provided within a flask and the drainer plate, the wire net, and said filtering cloth extending beyond an edge of said flask.

7. An apparatus according to claim 4, wherein said suction section further includes separator means for separating water and air between said water passages and the vacuum source.

8. An apparatus according to claim 7, wherein said suction section further includes atmosphere/vacuum selector valve adapted to connect said separator means selectively to atmosphere/vacuum source.

9. An apparatus according to claim 3, wherein said lower mould is fixed in place within a flask, said flask being adapted for vertical reciprocation taking selectively predetermined open and closed positions and a lower position, the upper mould being adapted for vertical reciprocation for taking a raised position and a lowered position to contact said flask in its raised position to press mould the cement mortar.

10. An apparatus according to claim 9, wherein said upper mould is being adapted for lateral movement in its raised position while maintaining its water sucking operation to carry the press moulded cement mortar laterally.

11. An apparatus according to claim 10, further including means for receiving the laterally carried cement mortar moulding.

12. An apparatus according to claim 11, wherein said receiving means includes a receiver plate, a carriage consisting of laterally spaced support surfaces to support said receiving plate, and a cylinder assembly adapted to actuate the carriage vertically.

13. An apparatus according to claim 12, further including conveyor means positioned between the laterally spaced opposite support surfaces and having an upper run positioned slightly above said support surfaces of the carriage when the carriage takes the lowest position.

14. An apparatus according to claim 13, further including a cylindrical wire brush mounted on a drum and rotatable about a horizontal shaft which is journalled to a framework positioned above a path of the conveyor means, the lowermost periphery of the cylindrical brush moving in a direction same as the conveyor means; and a slurry nozzle located ahead of the wire brush with respect to said direction, said slurry nozzle being inclined downward to have its hole directed toward a point where the horizontal plane containing the axis of the wire brush intersects the circumference of the wire brush adjacent to the nozzle.

15. An apparatus according to claim 3, wherein said upper mould is adapted for lateral movement, said lower mould being adapted for vertical reciprocation.

16. An apparatus according to claim 3, wherein said lower mould is adapted to take both vertical reciprocation and lateral reciprocation.

17. An apparatus for producing cement mortar mouldings comprising:

(a) an upper mould;

(b) a first lower mould for preliminary moulding and a second lower mould for color finish moulding, both adapted for horizontal movement to vertically align the upper moulding alternately;

(c) high pressure press means for actuating said upper mould;

(d) conveyor means spaced apart from said lower moulds; and (e) means for transferring horizontally the upper mould between the lower moulds and conveyor means for vertical alignment.

* * * * *